US006423280B1

(12) United States Patent
Tarara et al.

(10) Patent No.: US 6,423,280 B1
(45) Date of Patent: Jul. 23, 2002

(54) HYDRAULIC CONTROL OF DETERGENT CONCENTRATION IN AN AUTOMATIC WAREWASHING MACHINE

(75) Inventors: James J. Tarara, Woodbury; Glen W. Davidson, Roseville; Steven E. Lentsch, St. Paul, all of MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/182,121

(22) Filed: Oct. 29, 1998

(51) Int. Cl.[7] ..... B01D 11/02

(52) U.S. Cl. ..... 422/261; 134/93; 134/99.2; 137/268; 422/110; 422/114; 422/115; 422/261; 422/263; 422/275

(58) Field of Search ..... 134/10, 99.2; 252/95; 307/118; 422/261, 275; 137/268, 110, 114, 115, 261, 263

(56) References Cited

U.S. PATENT DOCUMENTS

| | | | | |
|---|---|---|---|---|
| 1,954,261 A | | 4/1934 | Pierce | |
| 2,308,612 A | | 1/1943 | Lehmkuhl | |
| 2,371,720 A | | 3/1945 | Stine | |
| 2,802,724 A | | 8/1957 | Johnson | |
| 3,595,438 A | * | 7/1971 | Daley et al. | 222/67 |
| 3,727,889 A | | 4/1973 | Nagel | |
| 3,850,344 A | | 11/1974 | Burge et al. | |
| 3,907,207 A | | 9/1975 | O'Brien | |
| 3,982,666 A | | 9/1976 | Kleimola et al. | |
| 4,020,865 A | | 5/1977 | Moffat et al. | |
| 4,063,663 A | | 12/1977 | Larson et al. | |
| 4,426,362 A | | 1/1984 | Copeland et al. | |
| 4,711,738 A | * | 12/1987 | Copeland | 134/10 |
| 4,733,798 A | | 3/1988 | Brady et al. | 222/23 |
| RE32,818 E | | 1/1989 | Fernholz et al. | |
| 4,845,965 A | | 7/1989 | Copeland et al. | |
| 4,858,449 A | | 8/1989 | Lehn | |
| 4,964,185 A | | 10/1990 | Lehn | |
| 5,007,559 A | | 4/1991 | Young | 222/1 |
| 5,137,694 A | | 8/1992 | Copeland et al. | |
| 5,268,153 A | | 12/1993 | Muller | 422/263 |
| 5,435,157 A | | 7/1995 | Laughlin | |
| 5,448,115 A | * | 9/1995 | Howland et al. | 307/118 |
| 5,505,915 A | | 4/1996 | Copeland et al. | |

* cited by examiner

*Primary Examiner*—Robert J. Warden, Sr.
*Assistant Examiner*—Imad Soubra
(74) *Attorney, Agent, or Firm*—Merchant & Gould P.C.

(57) ABSTRACT

An apparatus for maintaining an effective concentration of alkaline detergent in an aqueous medium in a warewashing machine, which apparatus comprises a batch-fill warewashing machine having an aqueous rinse system, an alkaline detergent dispenser and a sump sized for a predetermined volume of an aqueous solution of the alkaline detergent in the aqueous medium; a source of the aqueous medium fluidly connected to the rinse system; means for controlling the flow of the aqueous medium through the rinse system; diverting means for obtaining a predetermined portion of the aqueous flow from the rinse system and for directing the diverted portion through a metering cap and volume control to the alkaline detergent dispenser, thereby to dissolve the alkaline detergent; and means for directing the dissolved alkaline detergent to the sump; wherein the detergent is dispensed only in a rinse cycle and an effective concentration of alkaline detergent is maintained in the warewashing machine sump.

6 Claims, 5 Drawing Sheets

FIG. 8
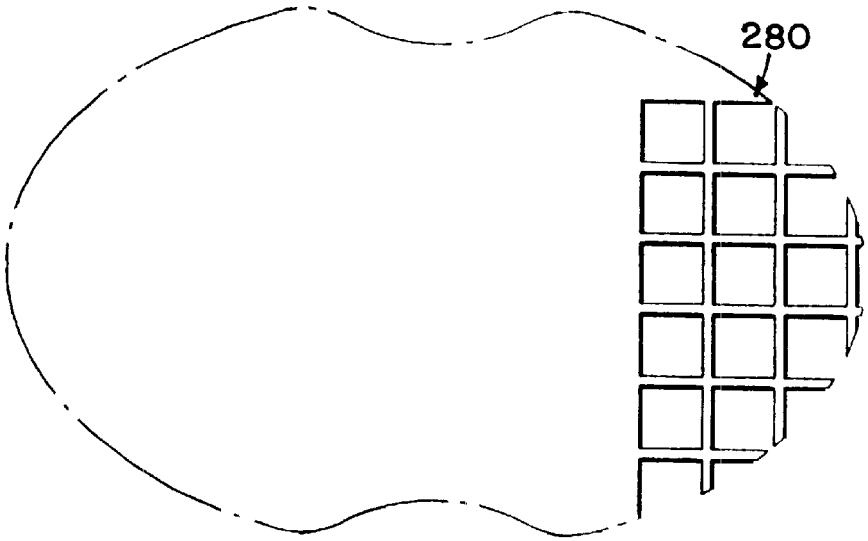
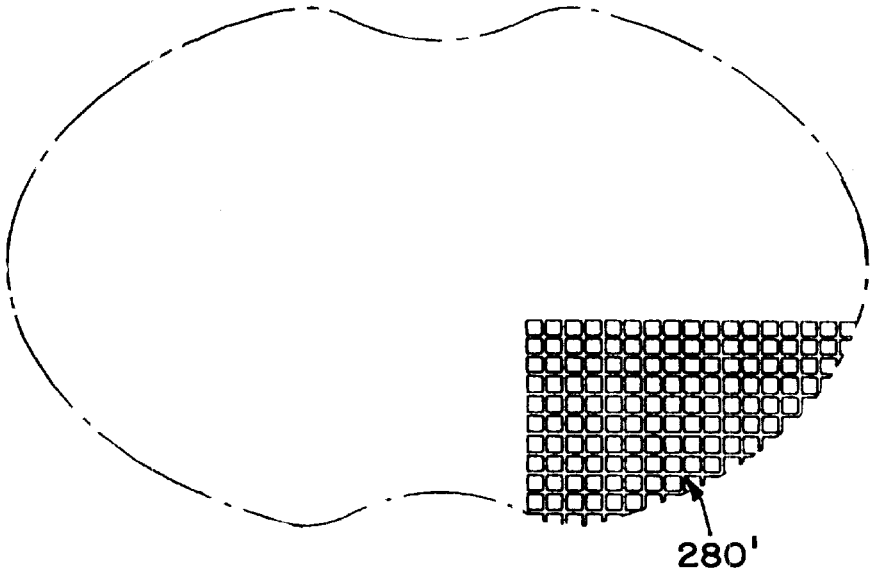
FIG. 9

HYDRAULIC CONTROL OF DETERGENT CONCENTRATION IN AN AUTOMATIC WAREWASHING MACHINE

FIELD OF THE INVENTION

The invention relates generally to the dissolution and dilution of concentrated solid materials and more specifically to the controlled dissolution and dilution of concentrated solid warewashing detergents to form concentrated liquid solutions. Detergent concentration control is provided exclusively via hydraulic means with no electronic detection of water usage or level, electronic control of detergent content or usage or electronic control of mechanical components.

BACKGROUND OF THE INVENTION

A number of different techniques have been developed and used for converting solid chemicals used in cleaning processes into a aqueous concentrated solution. For example, devices designed for a powdered, flaked or granular detergent are disclosed in Daley et al, U.S. Pat. No. 3,595,438, issued Jul. 27, 1991; Moffet et al, U.S. Pat. No. 4,020,865, issued May 3, 1977; and Larson et al, U.S. Pat. No. 4,063,663, issued Dec. 20, 1977. Another form of solid detergent is the pre-shaped detergent briquette. Dispensing systems for dissolving detergent briquettes are known in the art. See, for example, U.S. Pat. Nos. 2,382,163; 2,382,164; and 2,382,165 all issued Aug. 14, 1945 to MacMahon; and U.S. Pat. No. 2,412,819, issued Dec. 17, 1946 to MacMahon.

One recent form of solid detergent is the solid block form. The detergent block may comprise a detergent extruded or cast within a mold or container or as a detergent block which is free-standing. Dispensing systems for these solids are known in the art. See, for example, U.S. Pat. No. 4,426,362, issued to Copeland et al and commonly owned U.S. Pat. Nos. 4,569,781 and 4,569,780, issued Feb. 11, 1986, to Fernholz et al. The cast detergent is dispensed by spraying a solvent onto the detergent block within the container, thereby dissolving the exposed surface of the detergent to form a concentrated working solution. The concentrated working solution falls into a reservoir or is directed by a conduit to the wash tank of a washing apparatus. When the chemical compound within the container is completely utilized, the exhausted container may be simply discarded and a fully charged container may be placed in the dispenser.

Solid, cast chemicals used in cleaning processes are preferably cast in a sturdy container which can act as a mold, a shipping and storage container, and a dispenser housing. The cast chemical may be dispensed by inverting the container over a spray nozzle and impinging solvent directly onto the exposed surface or surfaces of the chemical contained therein. The container may either be retained within the dispenser as the chemical is being used, or the chemical may be removed from the container and placed into the dispenser. However, hazardous chemicals used in cleaning processes such as highly alkaline detergents are preferably packaged such that they can be dispensed without coming into physical contact with the human body.

Known dispensing devices have sought to maintain a relatively constant rate of the chemical being dispensed, or a constant concentration, by maintaining a fixed distance between the dissolving spray nozzle and the exposed and erodible surface of the solid block of chemical. See, for example, commonly owned U.S. Pat. No. 4,687,121, issued to Copeland on Aug. 18, 1987; U.S. Pat. No. 4,690,305, issued to Copeland on Sep. 1, 1987, and U.S. Pat. No. 4,826,661, issued to Copeland et al May 2, 1988. Alternatively, a separate control system has regulated the amount of detergent dispensed and has maintained a constant concentration, thereby making it unnecessary to control the nozzle to-eroding surface distance.

In many situations, however, it is desirable for the chemical concentration to be variable. The optimum chemical concentration depends upon such factors as the type of solid chemical being dispensed, the type of surface being cleaned, the amount of soil being removed from the fabric or surface being cleaned, the temperature of the solvent, the degree of mechanical action applied to the fabric or surface being cleaned, and the volume of cleaning solution being produced. In the past, adjusting the concentration of the cleaning solution has typically been done manually by the operator. That is, a certain amount of cleaning solution has been dispensed from the solid chemical, to which a certain amount of water is added. If a higher use solution concentration is desired, then less water is added to the concentrated cleaning solution. However, this procedure does not result in a consistent, precise, and controlled solution concentration, and often results in the use solution having either too much or too little cleaning chemical concentration.

U.S. Pat. No. 2,371,720 to Stine discloses an admixing and dispensing device applied to dishwashing machines. One of the objects of the invention is to "provide a method and device in which the rate of admixture is governed and controlled automatically by the flow of liquid". An upwardly disposed spray nozzle 10 projects a spray of water against a conical screen 8. The conical screen 8 supports a mass of caked or powdered chemical detergent. The water to the nozzle is provided by a pipe 20 which is the main rinse water supply. Water is directed to spray nozzle 10 through valve 15 and pipe 11. Valve 15 is of a design such that it also transmits a flow, proportional to the flow, through to a rinse line.

U.S. Pat. No. 2,308,612 to Lehmkuhl discloses a dissolving apparatus in which water from a spray head 61 falls upon powdered detergent. The detergent is held in an inner container 31 which has a foraminous partition 41 in its center. The concentration of the dissolved powder in the liquid is adjusted by moving the nozzle closer to or further from the detergent powder. Adjusting the height of the nozzle changes the relative proportions of the water sprayed into the inner container holding the detergent and water sprayed into the space between the side walls of the inner and outer containers.

U.S. Pat. No. 3,727,889 to Nagel discloses a fluid conduit 38 provided with a nozzle which projects a jet of liquid against a dry chemical. An automatically controlled valve 44 dispenses a predetermined amount of liquid against the chemical. The disclosure describes the control means 46 by a block diagram labeled "control" and states that "suitable automatic control means [are] well known in the art". The specification discloses a selector dial to select the amount of dilution water for a given cycle.

U.S. Pat. No. 4,964,185 to Lehn discloses a pressure regulating valve 35 which maintains a constant flow rate of solvent to spray nozzle 31. The spray nozzle sprays the solvent onto solid or granular chemicals retainably held above the nozzle. The device forms a concentrated chemical solution and controls the amount of chemical dispensed.

U.S. Pat. No. 5,505,915 to Copeland et al. discloses a solid chemical dispenser in which distance between the nozzle and the detergent can be varied. The position of the nozzle can be varied by a mechanical linkage or an automatic means such as a servo system.

U.S. Pat. No. 3,982,666 to Kleimola ct al. discloses a means to sequentially and automatically inject various liquid products into a laundry washing machine. The invention utilizes a signal generating device for generating electrical signals of a predetermined duration.

U.S. Pat. No. Reissue 32,818 to Fernholz et al. discloses a method of using a cast detergent-containing article. The patent describes positioning the solid detergent over "spray means which is connected to a water source".

There remains a need for a simple, accurate method of dissolving and diluting a concentrated solid warewashing detergent using solely hydraulic control without complicated electronic control of water, chemical or mixing.

BRIEF SUMMARY OF THE INVENTION

Accordingly, the invention involves a hydraulic method for dispensing and controlling detergent and rinse aid use and active concentration in a warewashing machine. Accurate dispensing and control of active detergent concentrations is obtained with no electronic detection or control of concentration. The value of the invention is that it uses fully hydraulic methods and avoids the complexity inherent in the use of electronic or electric controls. The dispensing means can have electronic components in the rinse feed system, with no electronic control of the detergent feed. The warewashing machine is plumbed such that a portion of the service water from a water supply such as the final rinse line is diverted to a water, spray-on solid block detergent dispenser. The volume of water impinging on the solid detergent that governs the amount of detergent dispensed is in turn governed by volume-limiting or flow-limiting metering tips. A metering tip is selected with the time elapse or time period extent of the rinse cycle in mind such that the amount of time water flows in the rinse step dispenses (using the bypassed water) the correct amount of detergent by the spray-on function. Whenever the rinse line is operated, in a periodic manner at in repeated time period and at a constant pressure, the correct amount of detergent is dispensed solid detergent is dispensed to maintain the effective correct cleaning amount of detergent in the wash water. With the appropriate size of metering tip in the dispenser and the correct timing of the final rinse cycle, the appropriate proportions of aqueous detergent and rinse volume can be obtained in the machine to achieve both effective cleaning and rinsing. The machine can be economically operated by appropriate settings of rinse volume, rinse timing and a metering tip for the water impinging on the solid detergent in the dispenser. Once the metering tips are calibrated for an installation the machine will typically dispense consistently until the local service water pressure changes substantially.

The invention is found in an apparatus for maintaining an effective concentration of alkaline detergent in an aqueous wash or aqueous medium in a warewashing machine, which apparatus comprises a batch-fill warewashing machine having an aqueous rinse system, an alkaline detergent dispenser and a sump sized for a predetermined volume of the alkaline detergent in the aqueous medium; a source of the aqueous medium fluidly connected to the rinse system; means for controlling the flow of the aqueous medium through the rinse system; diverting means for obtaining a predetermined portion of the aqueous flow from the rinse system and for directing the diverted portion through a metering cap and volume control to the alkaline detergent dispenser, thereby to dissolve the alkaline detergent; and means for directing the dissolved alkaline detergent to the sump; wherein the detergent is dispensed only in a rinse cycle and an effective concentration of alkaline detergent is maintained in the warewashing machine sump.

BRIEF DESCRIPTION OF THE FIGURES

FIG. 8 is a schematic for a grate or screen useful in the invention.

FIG. 9 is a schematic for a grate or screen useful in the invention.

DETAILED DESCRIPTION

Figure 1:
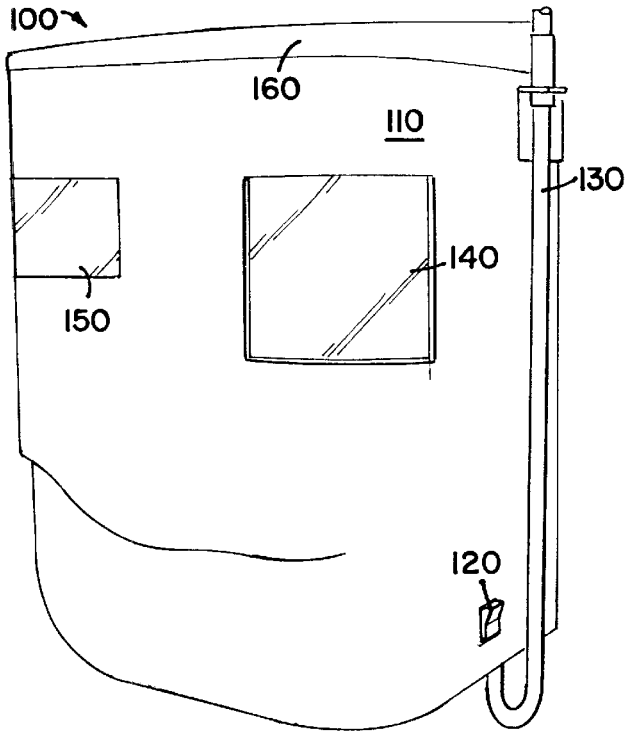
FIG. 1 is a perspective view of a dispenser typical of the invention

FIG. 1 shows a dispenser 100 typical of the invention. Generally shown is a housing 110 with viewing apertures 140 and 150 for visual inspection of detergent and rinse aid remaining, respectively. The housing 110 also has a flip up lid 160. Also seen is the incoming rinse line 130 and an on/off switch 120.

Figure 2:
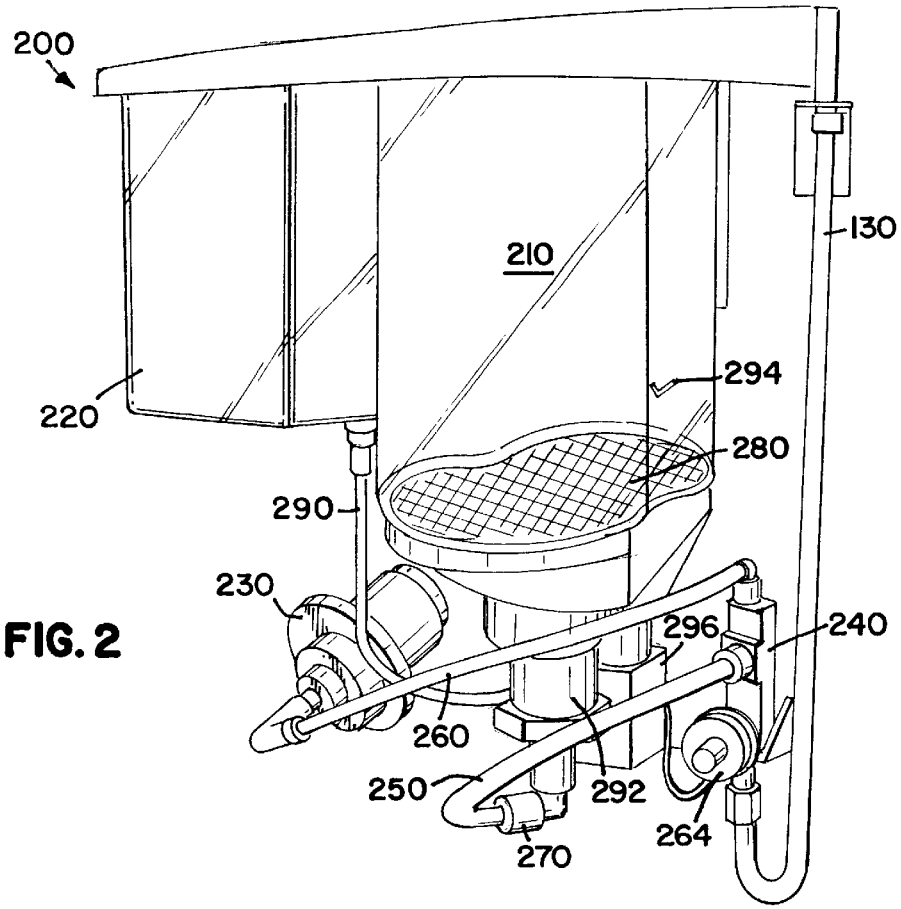
FIG. 2 is a perspective view of the same dispenser with the cover removed, exposing the components beneath.

FIG. 2 shows the internal components 200 of a dispenser typical of the invention. This figure shows the internal compartments 210 and 220 suitable for holding the solid block detergent and rinse aid, respectively. The plumbing is best described by tracing water flow through the device. Rinse water enters the apparatus 200 through a water line 130 and flows to a diverter valve 240. Seen is an electrical pressure sensor 264 which detects the flow of rinse water and activates the rinsing pump 230 as appropriate. In the diverter valve 240, a small amount of the rinse water is sent through water line 250 to a fitting 270 which is in fluid communication with spray housing 292.

Within spray housing 292 is a spray head (not seen in this Figure, see FIG. 3) which provides a source of water to impinge on the solid block detergent (not shown) which is supported by screen or grate 280. The dissolved detergent and diluent flows out of the apparatus 200 through an exit valve 296. The concentrated liquid detergent then is pumped into the wash tank in preparation for the next cycle.

The remaining rinse water flows through water line 260 to the rinsing pump 230. From here, a portion of the rinse water is sent through water line 290 and enters compartment 220, where it impinges upon a solid block rinse aid, thereby dissolving a portion of it. The rinse water (now containing a portion of dissolved rinse aid) is pumped via rinsing pump 230 to the rinsing portion of the warewashing machine. A final feature seen in FIG. 2 concerns an additional warning of low detergent content. When the height of the remaining detergent block drops below a predetermined level, check mark 294 is illuminated as an additional visual warning.

Figure 3:
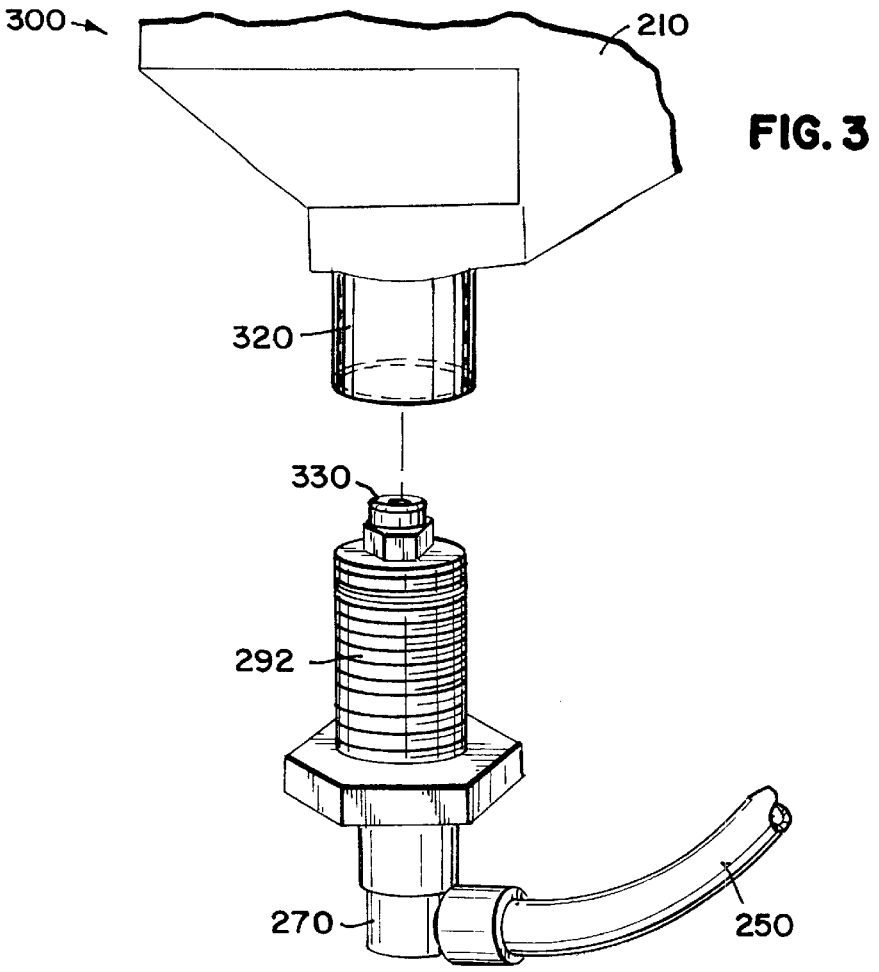
FIG. 3 is a closer view of a portion of FIG. 2. Specifically, the lower portion of the detergent block compartment is visible, along with the sprayhead.

FIG. 3 shows a portion 300 of the dispenser of the invention. Again, water line 250 and valve 270 are seen. Additional detail is seen in spray housing 292, in that a spray head 330 is visible. Also seen is the threaded nature of the spray housing 292, along with the complementary configuration of the aperture 320 at the bottom of compartment 210.

Figure 4:
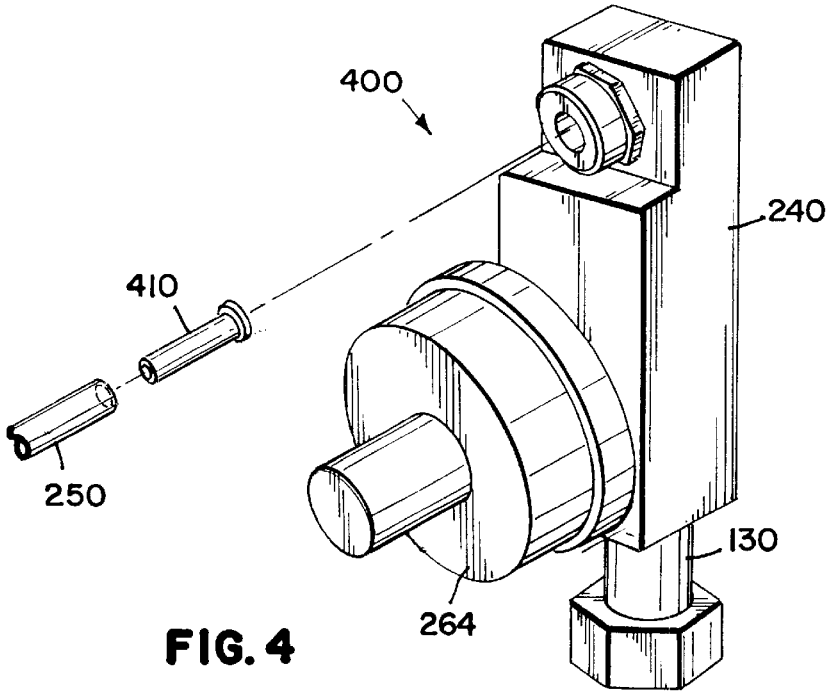
FIG. 4 is a closer view of another portion of FIG. 2. Specifically, this view provides a better look at the diverter valve and associated plumbing.

FIG. 4 is an exploded view 400 of the rinse water diverter valve 240. This shows the relationship between the valve 240, water line 250 and the metering tip 410.

Figure 5:
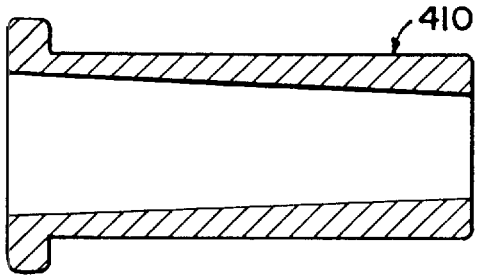
FIG. 5 is a schematic for a metering tip useful in the invention.

FIG. 5 is a schematic which shows a possible configuration 410 for a metering tip useful in the invention.

Figure 6:
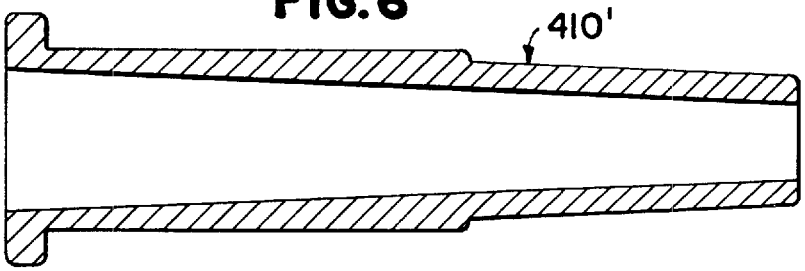
FIG. 6 is a schematic for a metering tip useful in the invention.

FIG. 6 is a schematic which shows a possible configuration 410' for a larger metering tip useful in the invention.

Figure 7:
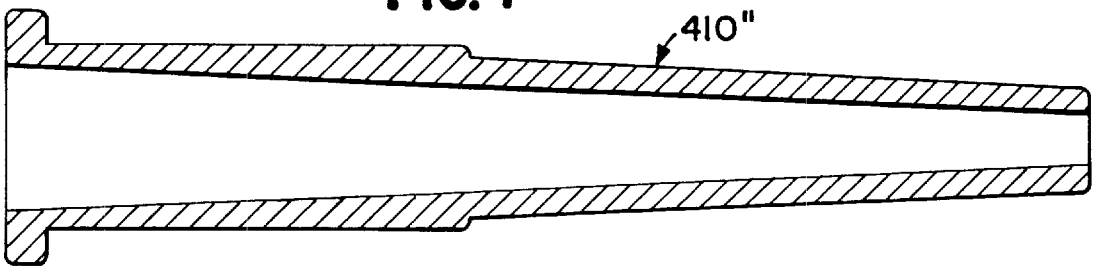
FIG. 7 is a schematic for a metering tip useful in the invention.

FIG. 7 is a schematic which shows a possible configuration 410" for a still larger metering tip useful in the invention.

FIG. 8 is a schematic which shows a possible configuration 280 for a screen or grate useful in the invention for supporting the solid block detergent.

FIG. 9 is a schematic which shows a possible configuration 280' for an alternate size screen or grate useful in the invention for supporting the solid block detergent.

Figure 10:
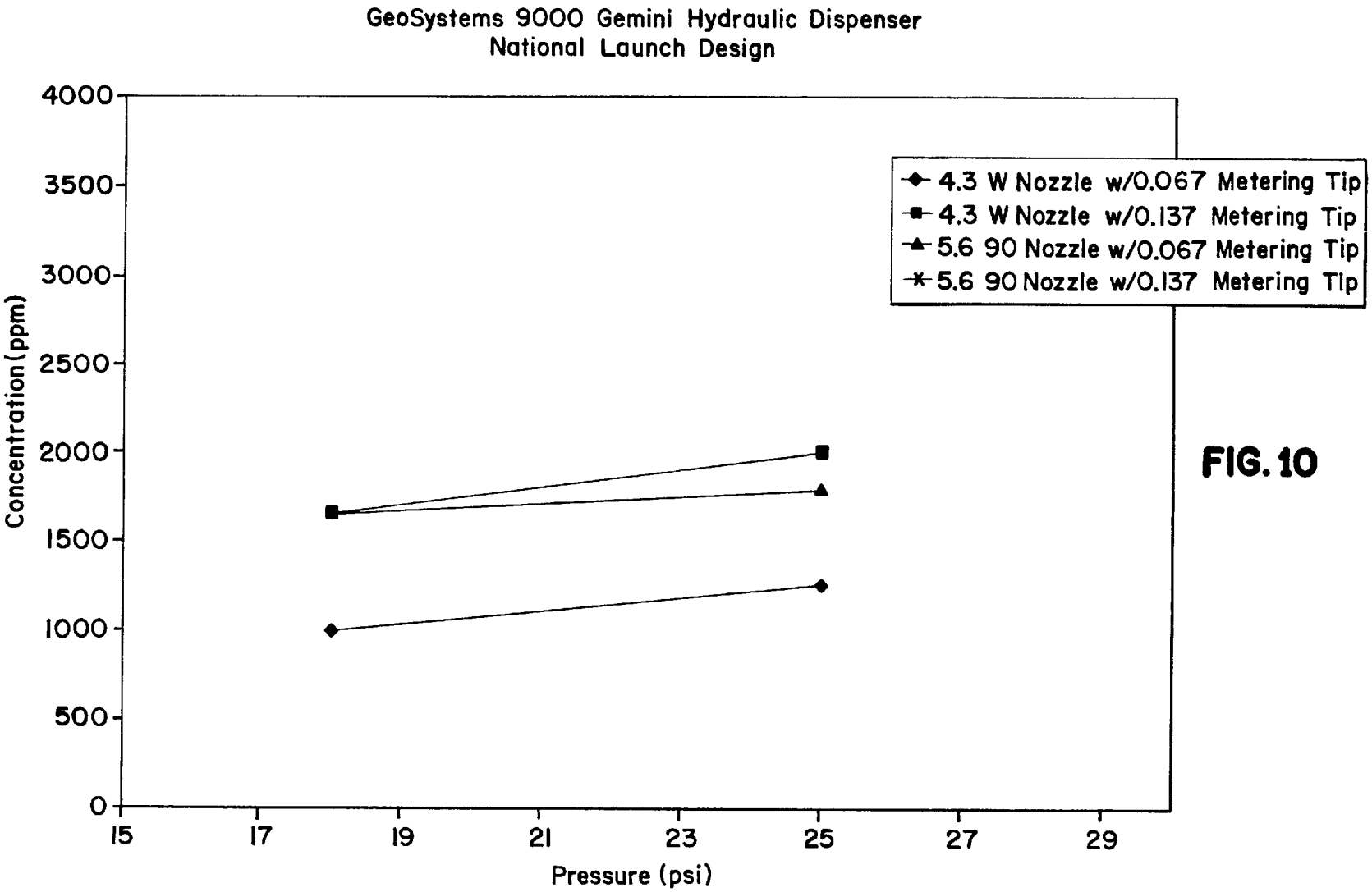
FIG. 10 is a graphical representation of the control over detergent concentration obtained by varying metering tip and pressure

FIG. 10 is a graphical representation of the concentration dispensed by the dispenser using as variables, the metering tip size and service water line pressure. As can be seen in the figure, the active concentration of the detergent through metering tips that have a size of about 0.067 inch or 0.137 inch used in conjunction with a nozzle having differing spray patterns. Dispensing the detergent at pressures that range from about 18 to 25 psi can vary the detergent concentration as the metering tip ranges from 0.067 to 0.137 inch from about 1000 ppm to about 1200 ppm. Similar variations in dispensing amounts can be seen with other combinations of nozzle and metering tip. The concentrations shown in this figure relate to the concentration of the detergent in the concentrate, not in the use solution sprayed on the dishes for active cleaning purposes.

Housing

The external housing of the apparatus is typically opaque and is suitable for labeling. The housing can be made of any engineering resin, while polyethylene, polypropylene, polystyrene, ABS, acrylics, etc, are preferred. The internal compartments are typically transparent or translucent and are made from polystyrene, polycarbonate or an acrylic.

Batch-fill Warewashing Machine

The apparatus of the invention is intended for use in batch-fill, non-continuous warewashing machines such as the Hobart Am 14 machine.

Rinse Water and Diverting Means

A portion of the rinse water is used to dissolve and dilute the concentrated solid detergent to form a concentrated liquid detergent which is pumped into the wash tank to provide wash solution for the next cycle. As shown in FIG. 2, incoming rinse water flows into a diverter valve which splits the incoming rinse diluent into two unequal streams; a low volume stream which serves to dissolve a portion of solid block detergent and a high volume stream which continues on as rinse water. Typically, the rinse diluent is split to the low volume stream of about 0.05 to 2 gal.-min$^{-1}$, preferably about 0.1 to 0.9 gal.-min$^{-1}$ to the detergent dispenser and to the high volume stream in the rinse aid dispenser at a rate greater than the low volume stream.

Metering Tips

The amount of detergent dissolved and dispensed is determined in part by the size of the metering tips used. FIGS. 5–7 show three possible metering tip configurations. All three embodiments shown possess the same taper angle. Therefore, the relationship between inlet and outlet inner diameters is determined solely by the overall length of the metering tip. In addition, each metering tip also has the same externally un-tapered length. The relevant data for each metering tip is given in the table below:

TABLE 1

Metering Tips Geometry (see also FIGS. 5–7)

| Inlet Inner Diameter (inches) | Outlet Inner Diameter (inches) | Overall Length (inches) | Flow Rate (gal.-min$^{-1}$ @ 10 psi) |
|---|---|---|---|
| 0.240 | 0.067 | 1.41 | 0.28 |
| 0.240 | 0.100 | 1.03 | 0.43 |
| 0.240 | 0.137 | 0.60 | 0.56 |

Obviously, the range of flow restrictions possible from each metering tip depends on the inlet diluent pressure, which can range within normal utility service water from about 5 to 50 psi.

Grate/Screen

The amount of detergent dissolved and dispensed is determined in part by the grid size of the supporting grate or screen used. FIGS. 8–9 show several possible grate or screens. The two embodiments shown are similar in overall size, with an overall length of 6.80 inches and an overall width of 4.45 inches. These dimensions are determined by the particular size of solid block detergent used and are not to be considered as limiting the invention in anyway. The overall horizontal shape of the screen or grate is determined in the same way. In these embodiments, the screens or grates are roughly bi-lobal.

The embodiments shown differ substantially in grid size. The first screen has a typical weave or square grid wherein the strands are on average 0.50 inches apart. In contrast, the other screen has a weave wherein the strands are only 0.13 inches apart. This dramatically affects the dissolution and dilution rates, as shown here.

Alkaline Detergent

The apparatus of the invention is designed to dispense any suitable solid warewashing detergent known to those in the art. The detergent can be dispensed in concentrations of detergent of about 50 to 3500 parts by weight of detergent per millions parts of diluent. Typically, said detergents comprise one or more surfactants, along with minor components and may optionally comprise bleaching agents. As examples, the standard, chlorinated and metal protecting formulations given below can be dispensed in the apparatus of the invention.

| Ingredients | Standard Formulation | Chlorinated Formulation | Metal Protecting Formulation |
|---|---|---|---|
| Dense Ash | 50.79 | 40.90 | 34.09 |
| Sodium Silicate | — | 2.00 | 17.50 |
| Sodium Tripolyphosphate | 30.00 | 29.02 | 28.75 |
| Hydroxyethylidene diphosphonic acid | — | 5.50 | 5.68 |
| Aminotrimethylene phosphonic acid | 5.90 | — | — |

-continued

| Ingredients | Standard Formulation | Chlorinated Formulation | Metal Protecting Formulation |
|---|---|---|---|
| Sodium Hydroxide (50%) | 4.38 | — | — |
| Potassium Hydroxide (45%) | — | 7.97 | 8.28 |
| Nonionic defoamer | 1.30 | 1.30 | 1.30 |
| Nonionic surfactant | 2.50 | 2.50 | 2.50 |
| Sodium dichloroisocyanurate | — | 4.25 | — |
| Inerts to 100% | 5.13 | 6.56 | 1.90 |

The above specification, drawings and testing provide a basis for understanding the invention. Many embodiments, however can be made without departing from the spirit of the invention. The invention is embodied in the claims hereinafter appended.

We claim:

1. An apparatus for maintaining an effective concentration of alkaline detergent in an aqueous medium in a warewashing machine, which apparatus comprises:

(a) a batch-fill warewashing machine having an aqueous rinse system, an alkaline detergent dispenser and a sump sized for a predetermined volume of the alkaline detergent in the aqueous medium;

(b) a source of the aqueous medium fluidly connected to the rinse system;

(c) means for controlling a flow of the aqueous medium through the rinse system;

(d) a diverter for splitting the flow of the aqueous medium into the two unequal streams and for obtaining a predetermined portion of the aqueous flow from the rinse system and for directing the diverted portion through a metering tip to the alkaline detergent dispenser, thereby to dissolve the alkaline detergent; and (e) means for directing the dissolved alkaline detergent to the sump;

wherein the detergent is dispensed and directed to the sump only during the rinse cycle and an effective concentration of alkaline detergent is maintained in the warewashing machine sump.

2. The apparatus of claim 1 wherein both the diverter and the metering tip can be varied independently to control the detergent dispensing rate.

3. The apparatus of claim 1 wherein detergent is dispensed and directed to the sump only while rinse water is flowing.

4. The apparatus of claim 1 wherein the apparatus comprises a grate with predetermined dimensions supporting the solid detergent that affects the dispensing rate.

5. The apparatus of claim 1 wherein the detergent concentration is achieved within 2 machine cycles.

6. The apparatus of claim 1 wherein the detergent dispenser also delivers a rinse aid.

* * * * *